US009874060B2

(12) United States Patent
Roodenburg et al.

(10) Patent No.: US 9,874,060 B2
(45) Date of Patent: Jan. 23, 2018

(54) OFFSHORE DRILLING SYSTEM, VESSEL AND METHODS

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/123,553

(22) PCT Filed: Mar. 3, 2015

(86) PCT No.: PCT/NL2015/050132

§ 371 (c)(1),
(2) Date: Sep. 2, 2016

(87) PCT Pub. No.: WO2015/133896

PCT Pub. Date: Sep. 11, 2015

(65) Prior Publication Data

US 2017/0074057 A1 Mar. 16, 2017

(30) Foreign Application Priority Data

Mar. 3, 2014 (NL) ..... 2012354

(51) Int. Cl.
*E21B 19/00* (2006.01)
*B63B 35/44* (2006.01)
(Continued)

(52) U.S. Cl.
CPC ..... *E21B 19/006* (2013.01); *B63B 35/4413* (2013.01); *E21B 7/128* (2013.01);
(Continued)

(58) Field of Classification Search
CPC ..... E21B 19/006; E21B 19/008; E21B 19/07; E21B 19/09; E21B 19/143; E21B 19/146;
(Continued)

(56) References Cited

U.S. PATENT DOCUMENTS 4,085,509 A 4/1978 Bell et al.
6,595,494 B1 7/2003 Roodenburg et al.
2008/0251258 A1* 10/2008 Bamford ..... F16L 1/161 166/355

FOREIGN PATENT DOCUMENTS

WO WO 99/31345 A1 6/1999
WO WO 01/29366 A1 4/2001
(Continued)

*Primary Examiner* — Matthew R Buck
*Assistant Examiner* — Patrick F Lambe
(74) *Attorney, Agent, or Firm* — Birch, Stewart, Kolasch & Birch, LLP

(57) ABSTRACT

Offshore drilling system for performing subsea wellbore related activities including a drilling vessel, with a floating hull subjected to heave motion. A main cable heave compensation sheave is provided for heave compensation of a travelling block. A connection cable heave compensation sheave is provided between a connection cable winch and a top sheave assembly supported on the hull of the vessel in or above the moonpool. The main cable heave compensation cable sheave and the connection cable heave compensation sheave are mechanically interconnected so as to allow for synchronous motion thereof.

20 Claims, 14 Drawing Sheets

Figure 1:
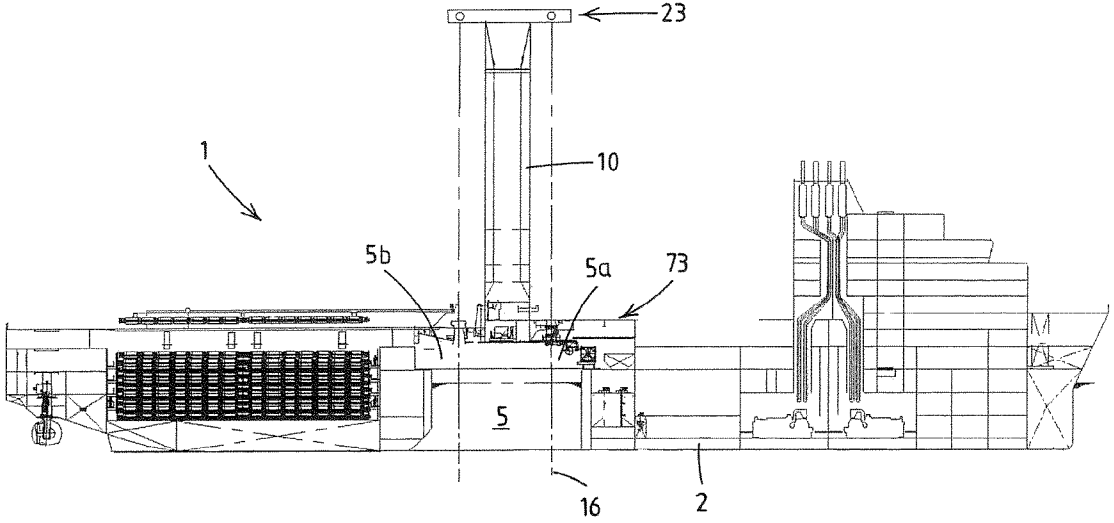

(51) Int. Cl.

| | |
|---|---|
| ***E21B 19/09*** | (2006.01) |
| ***E21B 7/128*** | (2006.01) |
| ***E21B 19/14*** | (2006.01) |
| ***E21B 15/02*** | (2006.01) |
| ***E21B 19/07*** | (2006.01) |
| ***E21B 33/08*** | (2006.01) |
| *E21B 19/16* | (2006.01) |

(52) U.S. Cl.
CPC ..... *E21B 15/02* (2013.01); *E21B 19/008* (2013.01); *E21B 19/07* (2013.01); *E21B 19/09* (2013.01); *E21B 19/143* (2013.01); *E21B 19/146* (2013.01); *E21B 33/085* (2013.01); *E21B 19/16* (2013.01)

(58) Field of Classification Search
CPC ..... E21B 19/16; E21B 7/128; E21B 15/02; B63B 35/4413
USPC ..... 166/355
See application file for complete search history.

(56) References Cited

FOREIGN PATENT DOCUMENTS

WO WO 0129366 A1 * 4/2001 ..... B66C 13/02
WO WO 2013/169099 A2 11/2013

* cited by examiner

OFFSHORE DRILLING SYSTEM, VESSEL AND METHODS

The present invention relates to an offshore drilling system for performing subsea wellbore related activities, e.g. drilling a subsea wellbore, comprising a floating drilling vessel that is subjected to heave motion due to waves.

The present invention also relates to a floating drilling vessel adapted for use in the system and to methods that are performed using the system.

In the art, e.g. as marketed by the present applicant, offshore drilling vessels are known that comprise:

- a floating hull subjected to heave motion, the hull comprising a moonpool,
- a drilling tower at or near the moonpool,
- a tubular string hoisting device, the tubular string for example being a drill string,
- hoisting device comprising:
  - a main hoisting winch and main cable connected to said winch,
  - a crown block and a travelling block suspended from said crown block in a multiple fall arrangement of said main cable, which travelling block is adapted to suspend a tubular sting, e.g. a drill string, therefrom along a firing line, e.g., with an intermediate topdrive adapted to provide a rotary drive for a drill string,
- a heave compensation system adapted to provide heave compensation of the travelling block, the heave compensation system comprising a main cable heave compensation sheave in the path between said main hoisting winch and the travelling block, a passive and/or active heave motion compensator device connected to said main cable heave compensation cable sheave,
- a riser tensioning system adapted to connect to a riser extending along the firing line between the subsea wellbore and the vessel, the riser tensioning system comprising a tension ring and tensioner members connected to said tension ring.

In a known embodiment, e.g. as disclosed in U.S. Pat. No. 6,595,494, a travelling block heave compensation system comprises two main cable heave compensation sheaves, each one in the path between one of the said main hoisting winches and the travelling block. Each of these sheaves is mounted on the rod of a compensator cylinder, with these cylinder connected, possibly via an intermediate hydraulic/gas separator cylinder, to a gas buffer as is known in the art.

In the offshore drilling field it is also known to make use of a slip joint, also referred to as telescopic joint. Commonly the slip joint has a lower outer slip joint barrel and an upper inner slip joint barrel, wherein the lower outer barrel is adapted to be connected to a fixed length section of the riser extending to the subsea wellbore to the riser. In known embodiments the slip joint is provided with a locking mechanism, e.g. with hydraulically activated dogs, which is adapted to lock the slip joint in a collapsed position. Known slip joints provided a higher pressure rating in the collapsed and locked position than in the dynamic stroking mode. For example slip joints are known to have one or more metal-to-metal high pressure seals that are operative in the collapsed and locked position, whereas in dynamic mode a hydraulically activated low pressure seal or seals are operative.

In the offshore drilling field it is known for the tension ring of the riser tensioning system to be connected to the outer barrel of the slip joint. Known tensioning systems include a wireline tensioning systems, wherein wire lines extend from the tensioning ring to tensioners on-board the vessel. Also known are direct-acting riser tensioning systems, wherein multiple cylinder units directly engage on the tension ring.

In the field of drilling so-called closed circulation methods become increasingly attractive, e.g. in view of improved control of pressure within the wellbore, e.g. during drilling. To this end a rotating control device, RCD, is arranged, commonly above the slip joint, to closed of the annulus between an upper riser member and the tubular string extending through the riser. One or more flowhead members below the RCD, or integrated therewith, allow for connection of one or more hoses so that annular fluid flow, e.g. return mud, can be transferred to the vessel. Due to the sealing of the annulus by the RCD control of fluid pressure in the annulus is possible, e.g. in view of techniques such as Managed Pressure Drilling.

It is an object of the invention to provide an improved system. For example the invention aims to provide for improved wellbore pressure control during drilling of the subsea wellbore. Another aim of the invention is to improve the practical use of equipment as addressed above, e.g. in view of drilling project efficiency, efforts of drilling personnel, etc.

The present inventions provides a system that is characterized in that the vessel is further provided with a cable connection system, which cable connection system comprises:

- an inner slip joint barrel connector that is adapted to the secured to the inner slip joint barrel,
- a connection cable winch and connection cable,
- a top sheave assembly supported in stationary operative position on the hull of the vessel in or above the moonpool, and a travelling bottom sheave assembly secured to the inner slip joint barrel connector, wherein the connection cable extends between the top sheave assembly and the bottom sheave assembly in a multiple fall arrangement,

- a connection cable heave compensation sheave in the path between the connection cable winch and the top sheave assembly, wherein the main cable heave compensation cable sheave and the connection cable heave compensation sheave are mechanically interconnected so as to allow for synchronous motion thereof.

In the inventive system, with the slip joint un-locked, subsea well related operations can be carried out with the slip joint absorbing the heave motion of the vessel. This is the preferably done from a drill floor working deck held in stationary position above the moonpool.

With the slip joint in collapsed and locked position, the travelling bottom sheave assembly has become stationary relative to the riser and thus to the seabed. As the vessel is subjected to heave, the distance between the top sheave assembly and bottom sheave assembly will vary due to the heave motion. As a result the connection cable will superimpose its motion on the heave compensation system that provides heave compensation of the travelling block. So with the slip joint locked an effective, accurate, and reliable heave compensation of the travelling block is operative. Once unlocked, this heave compensation system is still present and operable, yet not with the benefit of the superimposed effect caused by the connection cable linked to the inner barrel of the slip joint.

The invention system—with the slip joint locked—for example allows for highly accurate heave compensation in case an RCD seals the annulus between the riser and the drill string or other tubular string. As in this situation, with the locked slip joint and the RCD, the fluid volume within the riser effectively has become a fixed volume any heave motion, or residual heave motion, will result in major pressure variations of fluid in this fixed volume. The present inventive system allows to maintain such pressure variations, if any, to a limited and acceptable level.

In an embodiment the vessel is provided with a vertically mobile working deck that is vertically mobile within a motion range including a lower stationary position, wherein the working deck is used as stationary drill floor deck with the slip joint unlocked, and the motion range further including a heave compensation motion range that lies higher than said lower stationary position. In this heave compensation motion range the working deck can perform heave compensation motion relative to the hull of the vessel.

In an embodiment the system comprises an upper riser section that is adapted to be mounted on the riser and to extend upward from slip joint at least to above the lower stationary position of the working deck, preferably to the heave compensation motion range.

Preferably the working deck is adapted to rest onto the upper riser section, preferably with said upper riser section being the sole vertical loads support of the working deck. The latter embodiment is advantageous as optimal access to the upper riser section is available, e.g. for flowlines or other (electrical) lines leading to any equipment in said upper riser sections, for mudline(s), etc. For example such equipment can be one or more of an RCD, a diverter, a BOP, etc.

Preferably the vessel is provided with a drillers cabin deck and a drillers cabin thereon, with the lower stationary position of the working deck being at said drillers cabin deck level. This e.g. allows for the drilling personnel in said cabin to have a direct view on equipment in the upper riser section and lines attached thereto when operated with the slip joint collapsed and locked, and with the working deck in heave motion in said elevated heave motion compensation range.

The inventive system can also be embodied such that the working deck, in heave motion compensation mode, does not rest with its weight and, if present, load thereon on or entirely on the upper riser section. Then the working deck is provided with a downward depending deck frame, the travelling bottom sheave assembly being connected to a lower end of said downward depending deck frame. Such a deck frame may e.g. include vertical braces, a lattice work, etc.

As is preferred the working deck has an opening therein that is aligned with the firing line, the opening being dimensioned to at least allow for passage of the tubular string that extends into and through the riser.

As is preferred the working deck is provided with a tubular string suspension device, e.g. a device known as a slip in the drilling field.

The working deck may be provided with a rotary table.

As is preferred the top sheave assembly is arranged in its stationary operative position at a level below the working deck, e.g. below the working deck when in its lower stationary position. If desired the top sheave assembly can be movable between its stationary operative position and a retracted, e.g. sideways retracted, non-operative position. For example the top sheave assembly is mounted on a movable frame spanning the moonpool, e.g. movable on rails alongside the moonpool. Or the top sheave assembly can be suspended from an overhead deck structure, e.g. with rails allowing to move the top sheave assembly between an operative and a retracted position. The provision of the top sheave below the working deck floor allows for unhindered access to the working deck, e.g. from the side in piperacking operations between the firing line and a tubular storage rack.

As is known in the art, in a preferred embodiment, the main hoisting device comprises a first main hoisting winch and a second main hoisting winch, wherein the main cable is connected at either end thereof to a respective one of the first and second main hoisting winches. This e.g. allows for redundancy of the winches in the main hoisting device.

In an embodiment the heave motion compensation device comprises a first main cable heave compensation sheave in the path between the first main hoisting winch and the travelling block, a passive and/or active first heave motion compensator device connected to said first main cable heave compensation cable sheave, and the heave motion compensation device comprises a second main cable heave compensation sheave in the path between the second main hoisting winch and the travelling block, a passive and/or active second heave motion compensator device connected to said second main cable heave compensation cable sheave.

In an embodiment each heave motion compensator device comprise a hydraulic cylinder having a piston rod, the main cable heave compensation sheave being connected to said piston rod. The hydraulic cylinder is connected to a hydraulic/gas separator cylinder, one chamber thereof being connected to a gas buffer as is known in the art.

For example the compensator cylinder has a stroke between 5 and 15 meters, e.g. of 6 meters.

In an embodiment a two connector cable winches are provided, each connected to an end of the connector cable. This arrangement provides for redundancy of said connector cable winches.

In an embodiment a first connector cable heave compensation sheave is arranged in the path between the first connector cable winch and the top sheave assembly, wherein a second connector cable heave compensation sheave is arranged in the path between the top sheave assembly and the second connector cable winch. In an alternative said second end is connected to a stationary end terminal. In this arrangement the first and second connector cable heave compensation sheaves are mechanically connected to the first and second main cable heave compensation sheaves respectively to allow for synchronous motion thereof in order to obtain the desired superposition.

In an embodiment the top and bottom sheave assemblies each have a left-hand set with one or multiple sheaves and a right-hand set with one or multiple sheaves, the left-hand and right-hand sets being arranged at opposites sides of the firing line and being spaced apart to allow for passage of a riser member in the firing line and between said sets, preferably the sheaves of said sets have a common sheave axis that intersects the firing line. In an embodiment the sets of the bottom sheave assembly are mounted on a carrier frame or beam that also carries or forms the inner barrel connector. For example the carrier frame or mean has a central recess or opening therein allowing the passage of the upper riser section.

In an embodiment one or more main cable sheaves connected to the travelling block have an individual lower latching device allowing to connect and disconnect the individual sheave to and from the travelling block. Preferably these one or more sheaves also have an upper latching device allowing to latch the sheave to the crown block if the sheave is disconnected from the travelling block. This "splittable block" arrangement is known in the art.

In an embodiment, preferably in combination with a splittable block for the travelling block, one or more of the sheaves of the bottom sheave assembly have an individual lower latching device allowing to connect and disconnect the individual sheave to and from the inner barrel connector. Preferably these one or more sheaves also have an upper latching device allowing to latch the sheave to the top sheave assembly if the sheave is disconnected from the inner barrel connector.

In an embodiment the tower is a mast having a top and a base, the base adjacent the moonpool, wherein one or more hydraulic cylinders of the one or more heave motion compensator devices are arranged within said mast, e.g. in vertical orientation therein. In an embodiment the connector able extends from a sheave at an elevated position along the mast down along a face of the mast, e.g. along the exterior of an outer face of the mast, to a base sheave at the base of the mast, and from said base sheave to a top sheave assembly, preferably below the lower stationary position of the working deck.

In an embodiment the vessel is provided with a riser wireline tensioning system with one or more wirelines that depend from respective wireline sheaves and connect to the tension ring that is connectable to the outer barrel of the slip joint. Or the riser tensioner may be a direct-acting telescopic riser tensioner with multiple telescopic tensioner legs that connect to the tension ring.

The present invention also relates to a drilling vessel comprising:

- a floating hull subjected to heave motion, the hull comprising a moonpool,
- a drilling tower at or near the moonpool,
- a tubular string hoisting device, the tubular string for example being a drill string, the hoisting device comprising:
  - a main hoisting winch and main cable connected to said winch,
  - a crown block and a travelling block suspended from said crown block in a multiple fall arrangement of said main cable, which travelling block is adapted to suspend a tubular sting, e.g. a drill string, therefrom along a firing line, e.g., with an intermediate topdrive adapted to provide a rotary drive for a drill string,
- a heave compensation system adapted to provide heave compensation of the travelling block, the heave compensation system comprising a main cable heave compensation sheave in the path between said main hoisting winch and the travelling block, a passive and/or active heave motion compensator device connected to said main cable heave compensation cable sheave,
- a riser tensioning system adapted to connect to a riser extending along the firing line between the subsea wellbore and the vessel, the riser tensioning system comprising a tension ring and tensioner members connected to said tension ring, wherein the tension ring of the riser tensioning system is adapted to be connected to the outer barrel of a slip joint, characterized in that the vessel is further provided with a cable connection system, which cable connection system comprises:

- an inner slip joint barrel connector that is adapted to the secured to an inner slip joint barrel,
- a connection cable winch and connection cable,
- a top sheave assembly supported in stationary operative position on the hull of the vessel in or above the moonpool, and a travelling bottom sheave assembly secured to the inner slip joint barrel connector, wherein the connection cable extends between the top sheave assembly and the bottom sheave assembly in a multiple fall arrangement,

- a connection cable heave compensation sheave in the path between the connection cable winch and the top sheave assembly, wherein the main cable heave compensation cable sheave and the connection cable heave compensation sheave are mechanically interconnected so as to allow for synchronous motion thereof.

As will be appreciated the inventive vessel is most advantageous when the vessel has onboard a slip joint having a lower outer slip joint barrel and an upper inner slip joint barrel, wherein the outer barrel is adapted to be connected to a fixed length section of the riser extending to the subsea wellbore, and wherein the slip joint is provided with a locking mechanism adapted to lock the slip joint in a collapsed position.

The present invention also relates to a drilling vessel comprising:

- a floating hull subjected to heave motion, the hull comprising a moonpool,
- a drilling tower at or near the moonpool,
- a tubular string hoisting device, the tubular string for example being a drill string, the hoisting device comprising:
  - a main hoisting winch and main cable connected to said winch,
  - a crown block and a travelling block suspended from said crown block in a multiple fall arrangement of said main cable, which travelling block is adapted to suspend a tubular sting, e.g. a drill string, therefrom along a firing line, e.g., with an intermediate topdrive adapted to provide a rotary drive for a drill string,
- a heave compensation system adapted to provide heave compensation of the travelling block, the heave compensation system comprising a main cable heave compensation sheave in the path between said main hoisting winch and the travelling block, a passive and/or active heave motion compensator device connected to said main cable heave compensation cable sheave,
- vertically mobile working deck, providing a floor having an opening through which the firing lines passes,
- a riser tensioning system adapted to connect to a riser extending along the firing line between the subsea wellbore and the vessel, the riser tensioning system comprising a tension ring and tensioner members connected to said tension ring, characterized in that the working deck is provided with a downward depending working deck frame below the floor, and wherein the vessel is further provided with a cable connection system, which cable connection system comprises:

- a connection cable winch and connection cable,
- a top sheave assembly supported in stationary operative position on the hull of the vessel in or above the moonpool, below the working deck floor, and a travelling bottom sheave assembly secured to a lower end of the working deck frame, wherein the connection cable extends between the top sheave assembly and the bottom sheave assembly in a multiple fall arrangement,

- a connection cable heave compensation sheave in the path between the connection cable winch and the top sheave assembly, wherein the main cable heave compensation cable sheave and the connection cable heave compensation sheave are mechanically interconnected so as to allow for synchronous motion thereof.

For example the working deck is provided with a riser connector to secure the working deck to a riser extending in the firing line, e.g. to the top end of the riser or to an inner barrel of a slip joint in the riser.

The arrangement allows to provide synchronous heave compensation motion of the travelling block and of the working deck, whilst keeping the working deck floor fully accessible. This e.g. allows for piperacking operations to be performed between the firing line and a tubular storage rack without any hindrance. For example, this is a favorable solution compared to the solutions disclosed in WO 2013/169099. In simple embodiment described therein the working deck is suspended directly by rods, cables, or chains from the travelling block so that is follows the heave compensation motion thereof. The WO2013/169099 document describes that well entry equipment, e.g. a coiled tubing injector head unit, is placed on the working deck. Whilst for such an operation any direct suspension device between the working deck and travelling block may not be problematic, such a suspension device does limit access to the firing line, and may therefor limit the operational capability of the vessel in view of the variety of activities to be performed.

The inventive systems allow to obtain synchronous heave compensating motion of the working deck and the travelling block in a simple manner with high accuracy and reliability. By virtue of the connection cable winch one can position the working deck independent from the travelling block position, e.g. with the provision of choosing an upper riser section of the correct length, e.g. by addition of small length riser elements.

By suitable control of the connector cable winch it may be possible to bring the working deck in a stationary position relative to the hull, e.g. with the slip joint unlocked, e.g. in a lowermost parking position, possibly the working deck being locked in said parking position, whereas the travelling block may be continued to operate in heave compensation mode.

In a very practical embodiment the main cable heave compensation cable sheave and the connector cable heave compensation sheave are mounted in a common rigid carrier, e.g. the carrier being secured to the rod of a compensator cylinder.

The inventive system may be embodied so that the connector winch and cable system are adapted to support a vertical load whilst in heave compensation motion of at least 300 metric tonnes, e.g. between 400 and 800 metric tonnes.

As will be explained in more detail below it is envisaged, in an embodiment, with the slip-joint locked and an RCD in place, drilling is performed by means of a topdrive attached to the travelling block and by addition of drill pipes to the drill string that extends through the suspended riser. The working deck is then provided with a drill string slip device adapted to support the drill string as a new drill pipe is attached to the drill string, or when a drill string is removed during tripping. During this operation both the travelling block and the working deck are in heave compensation mode relative to the hull of the vessel. Due to the accuracy provided by the inventive system, even with the fluid volume in the riser being constant due to the RCD, the pressure variations within the wellbore are limited thus enhancing drilling techniques like Managed Pressure Drilling. The managed pressure drilling activity can then be performed without the pressure limitation of the otherwise dynamically stroking slip joint.

In an embodiment it is envisaged that the inventive system is embodied so as to allow for drilling and in said process adding new drill pipe to the drill string whilst the slip joint is in collapsed and locked position, e.g. with the working deck being in heave compensation mode, e.g. resting on the top end of the riser.

In an embodiment the vessel is provided with a drilling pipes storage rack, e.g. a carousel, adapted for storage of drill pipes in vertical orientation therein, the drill pipe storage rack being mounted on the hull so as to be subjected to heave motion along with the hull. The vessel is further provided with a pipe racker system that is adapted to move a pipe section between the drill pipe storage rack and a position in the firing line between the working deck and the travelling block. A drill string slip is provided that supports the suspended drill string within the riser when the drill string is disconnected from the travelling block, e.g. from the topdrive, in view of the connection of a new drill pipe to the suspended drill string.

This pipe racker system is provided with a heave motion synchronization system that is adapted to bring a drill pipe retrieved from the drill pipe storage rack into a vertical motion synchronous with the heave motion of the suspended drill string relative to the hull of the vessel in the collapsed and locked position of the slip joint. If a vertically mobile working deck is provided, it is deemed advantageous if the slip device is mounted on or in said working deck, with the deck being in heave motion, e.g. as it rests on the top end of the riser.

The above pipe racker system thus allows for drilling operations to be performed with the top end of the riser and the drill string slip device, possibly also a working deck supporting the slip device, in heave motion relative to the hull of the vessel. This allows said drilling operation to be performed with the slip joint locked, and e.g. allows for the use of an RCD device to seal the annulus and therefor obtain a controlled pressure within the riser, e.g. in view of Managed Pressure Drilling.

In embodiment the vessel is provided with an iron roughneck device arranged on the working deck, e.g. on the vertically mobile mobile working deck. This e.g. allows the use of the iron roughneck deck for make-up or break-up of the threaded connection between drill pipes or other tubulars.

In an alternative embodiment the vessel has an iron roughneck device that is not mounted on the working deck, but is instead independently supported from the hull of the vessel, e.g. vertically mobile along a rail mounted to the tower by means of a vertical drive. The iron roughneck device is then provided with a heave motion vertical drive adapted to move the iron roughneck device in heave motion in synchronicity with the heave motion of the suspended drill string, so that the iron roughneck device can operate whilst in heave motion.

The heave motion compensating pipe racker system can be used to move drill pipes, e.g. double or triple pipe stands, between the drill pipe storage rack and the firing line so as to connect a new drill pipe to the pipe string held by the slip device whilst in heave motion. It is envisaged that this may be of great value for managed pressure drilling wherein highly accurate control of borehole pressure is desired.

Figure 2:
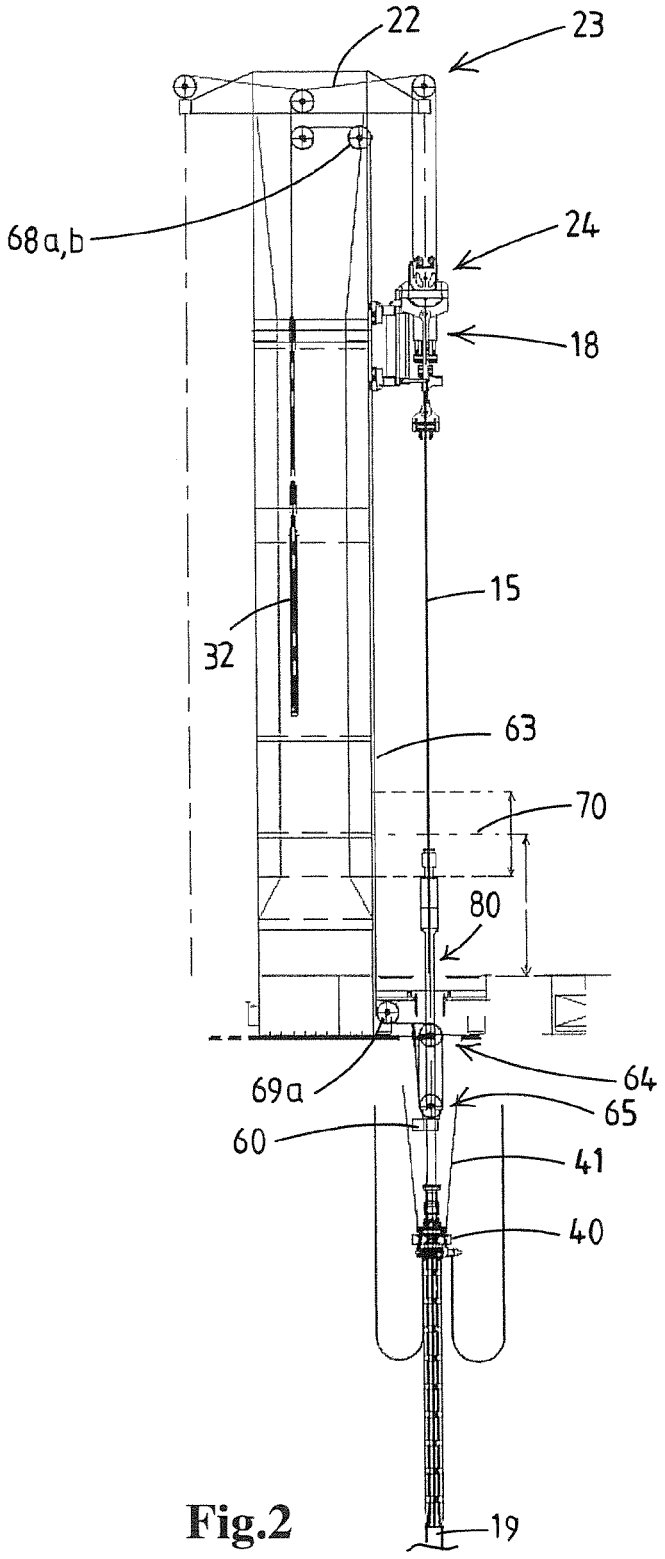
Figure 3:
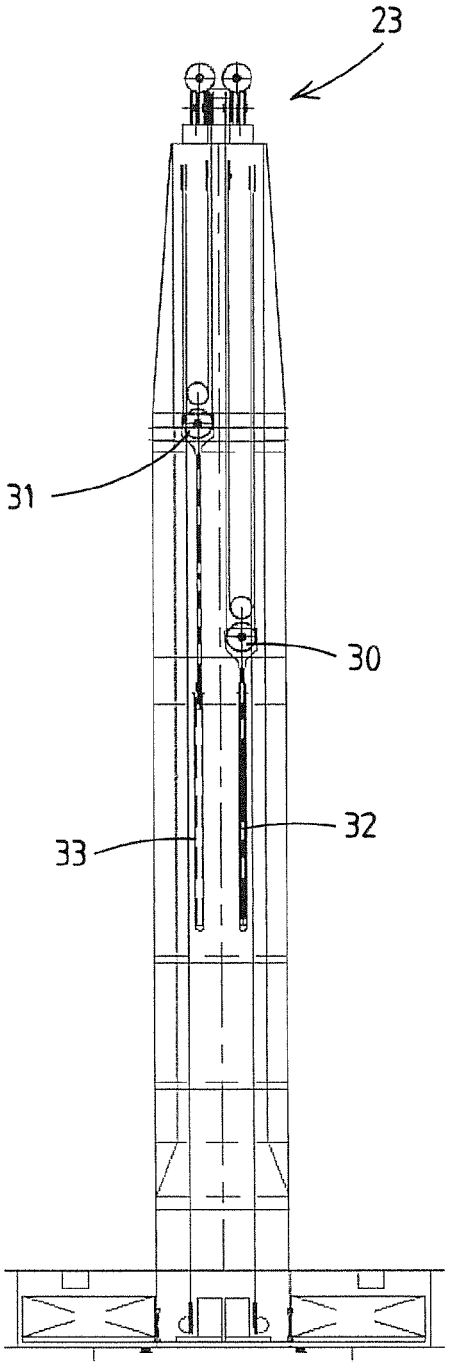
Figure 4:
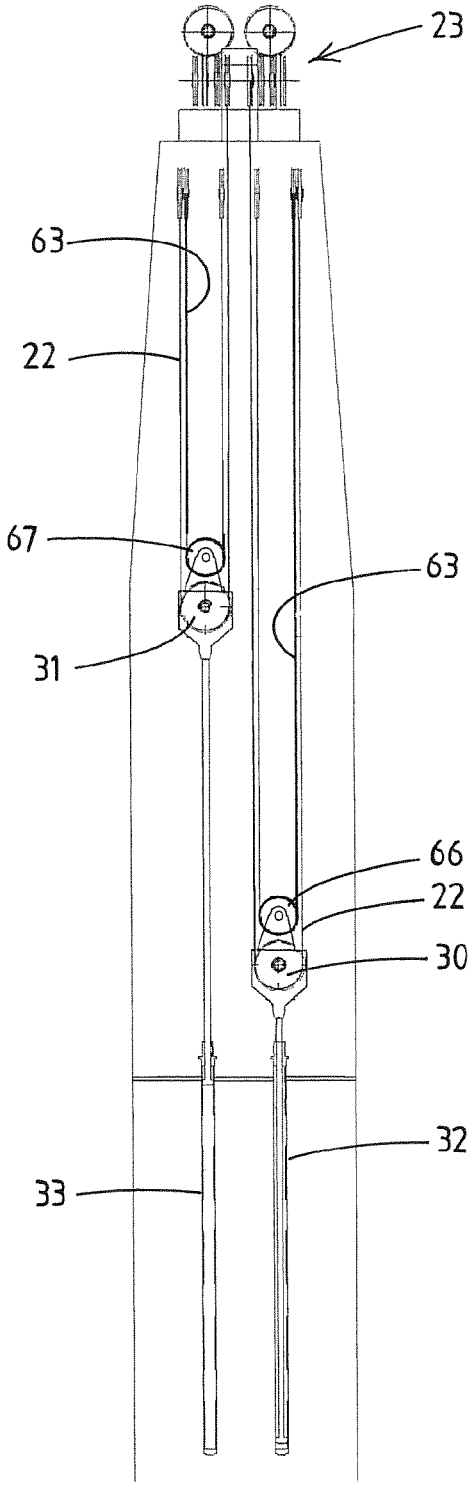
Figure 5:
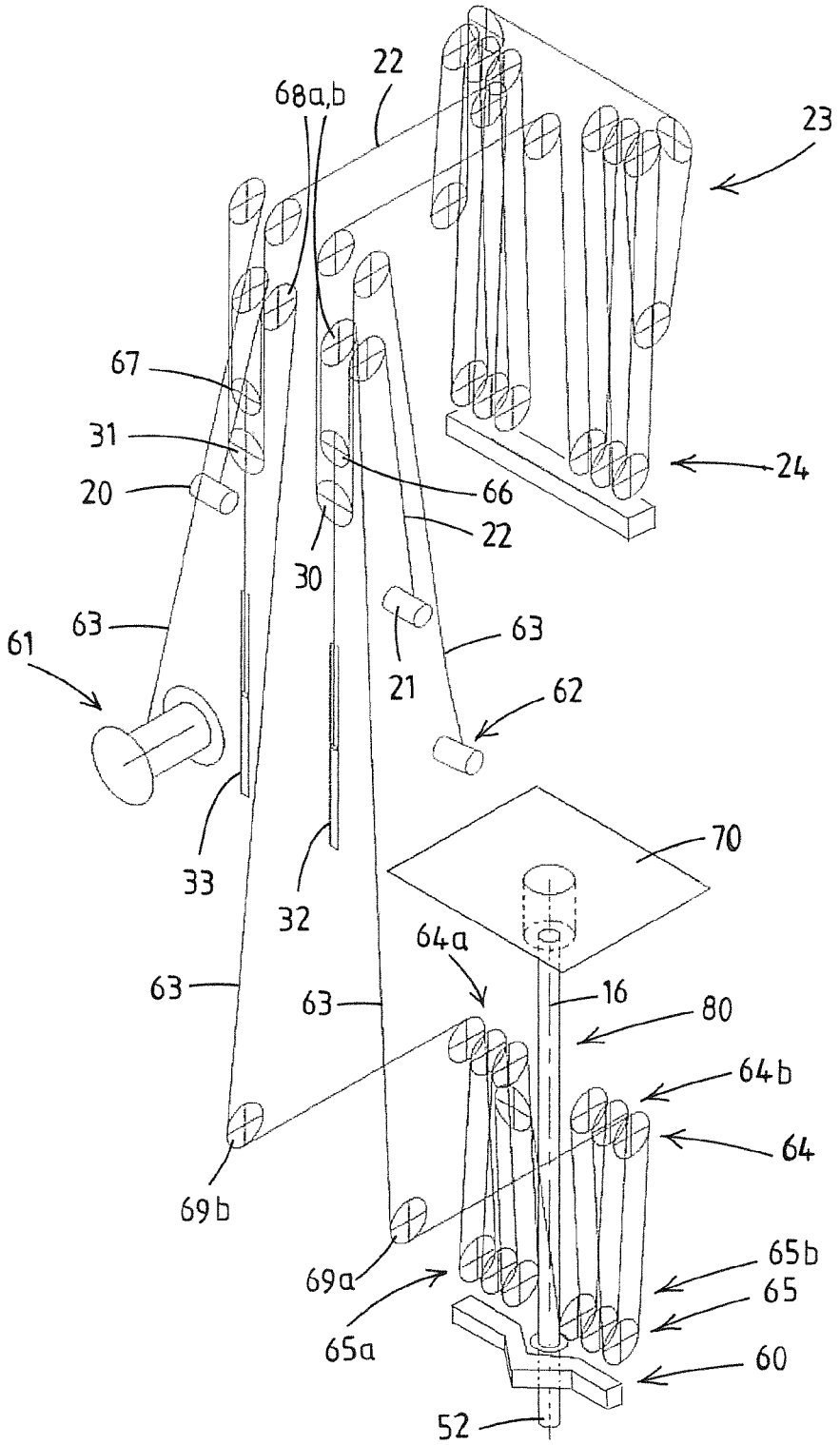
Figure 6:
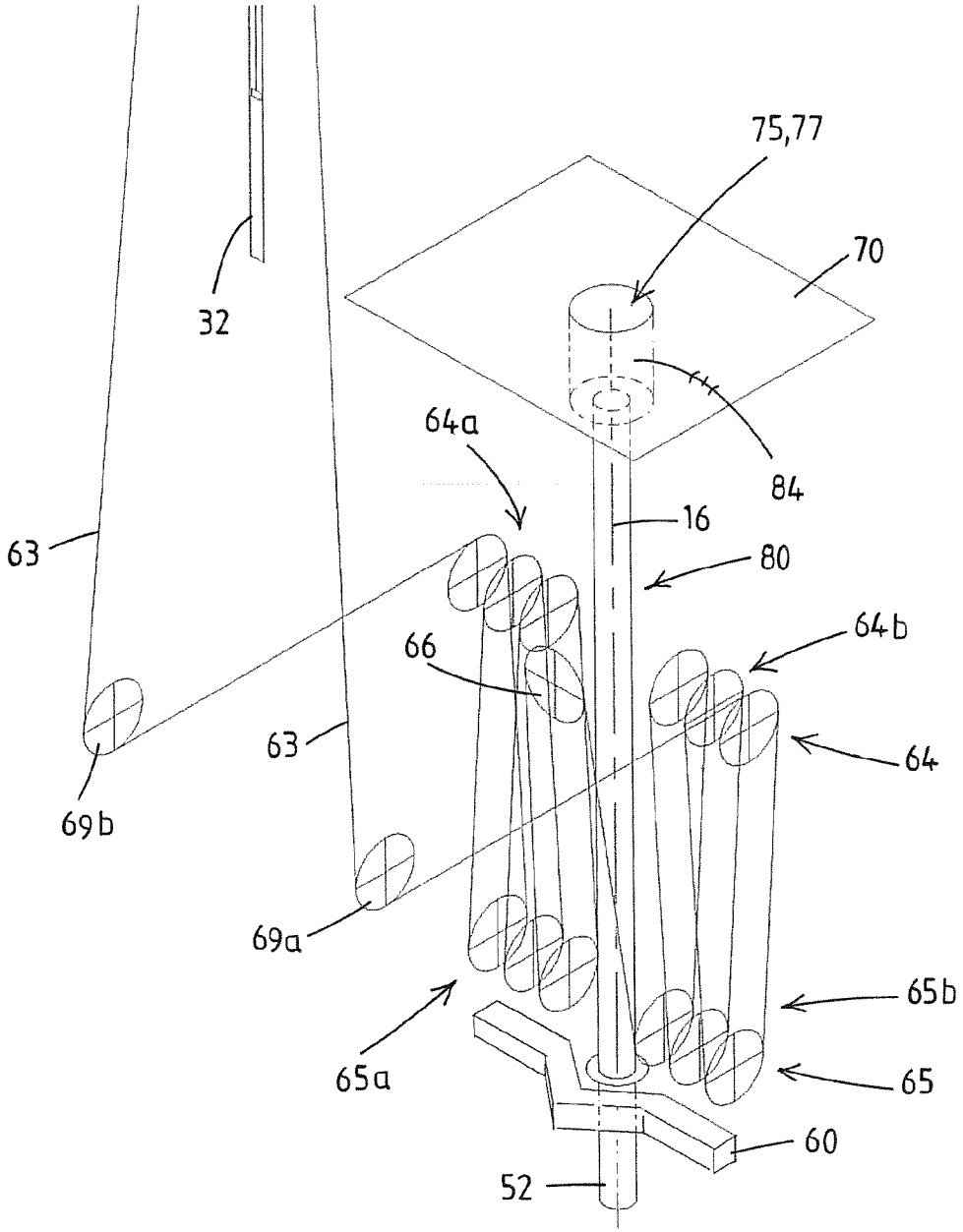
Figure 7:
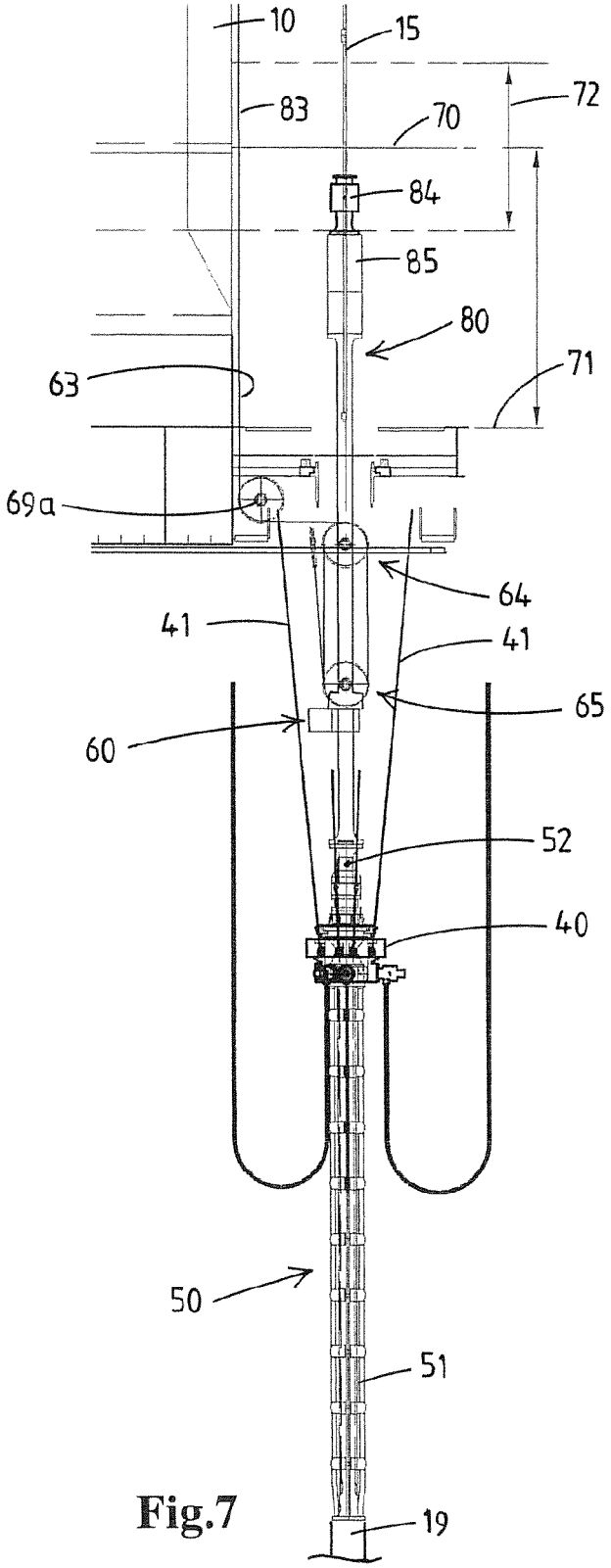
Figure 8:
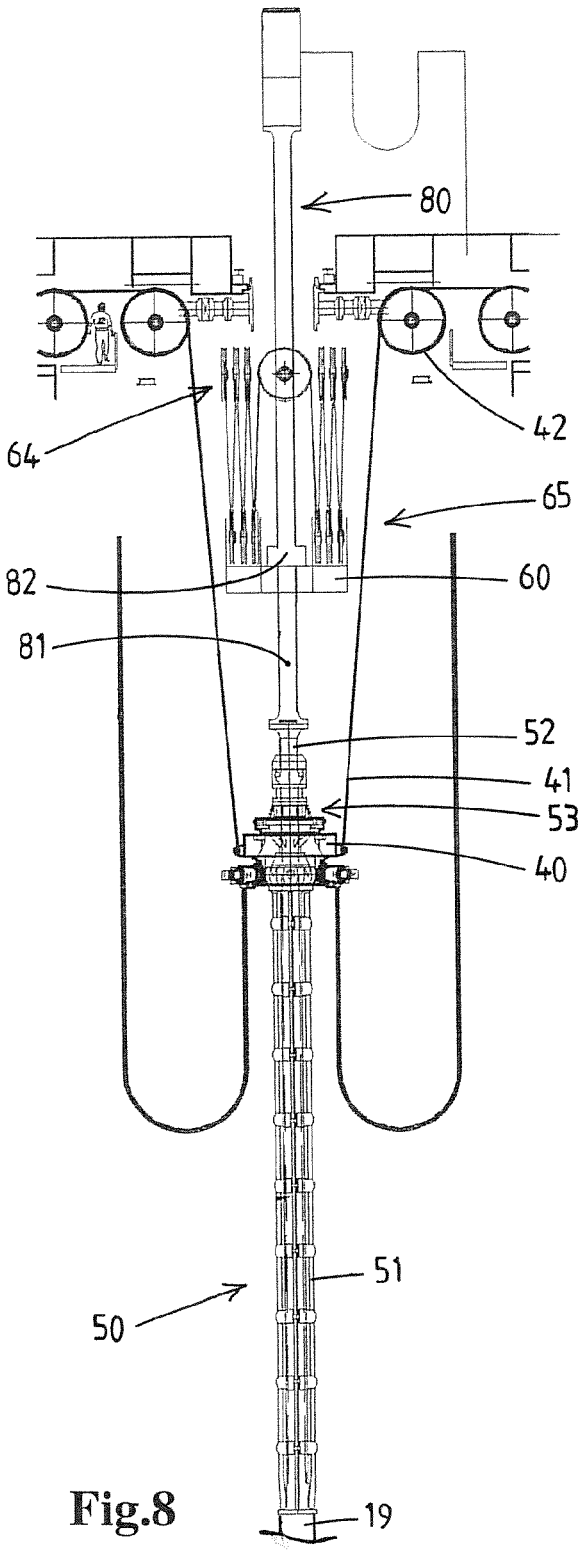
Figure 9:
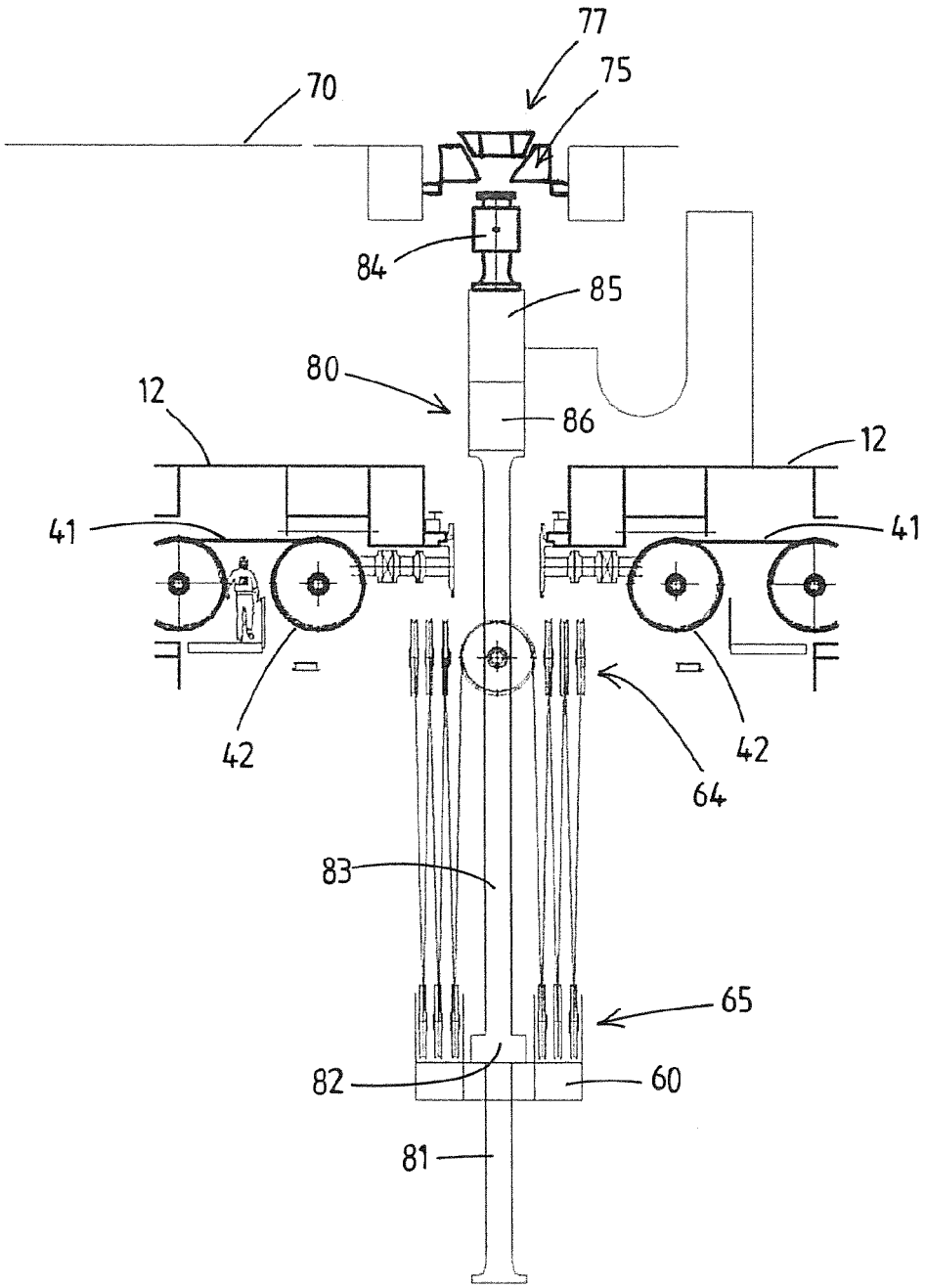
Figure 10:
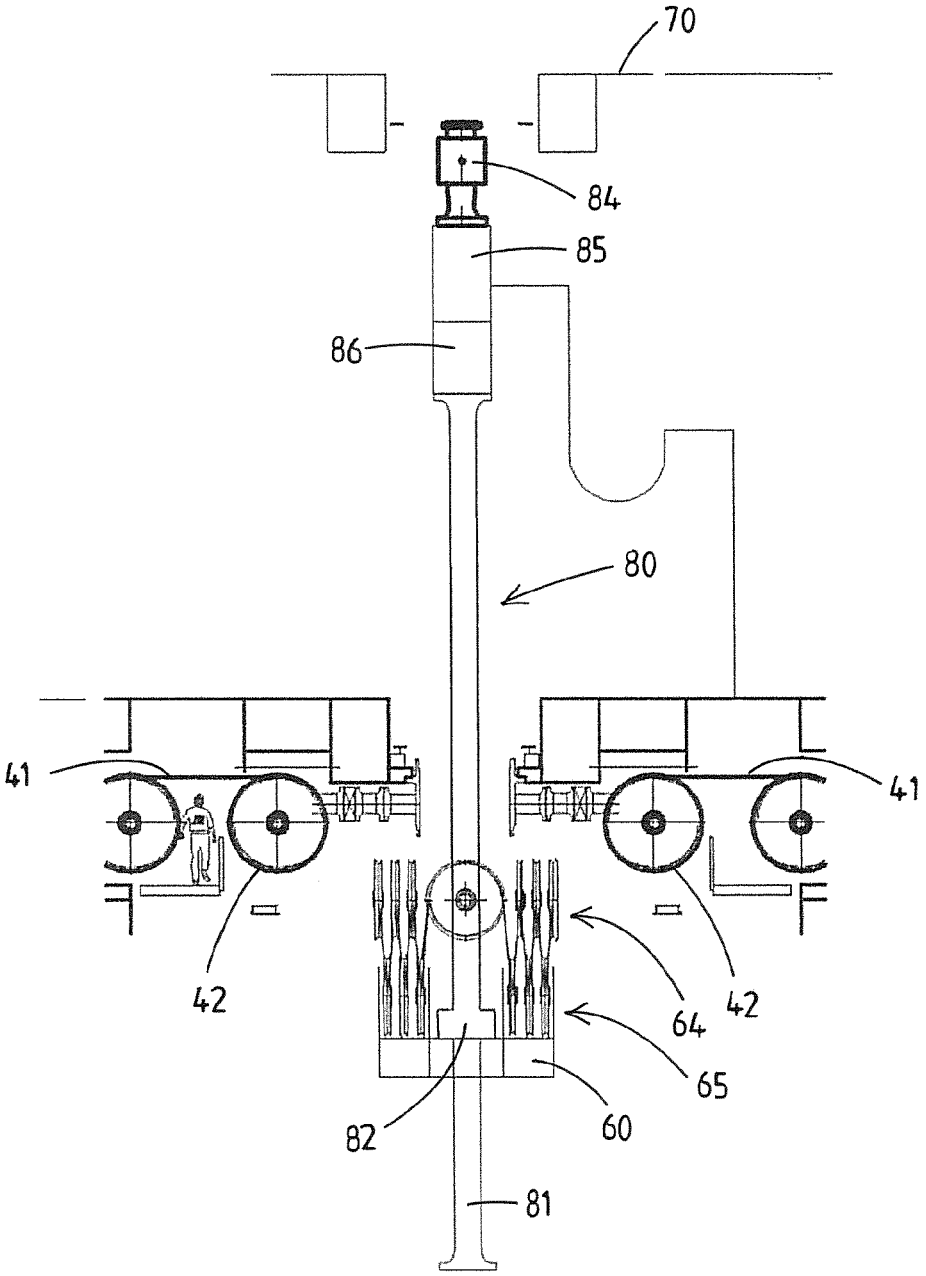
Figure 11:
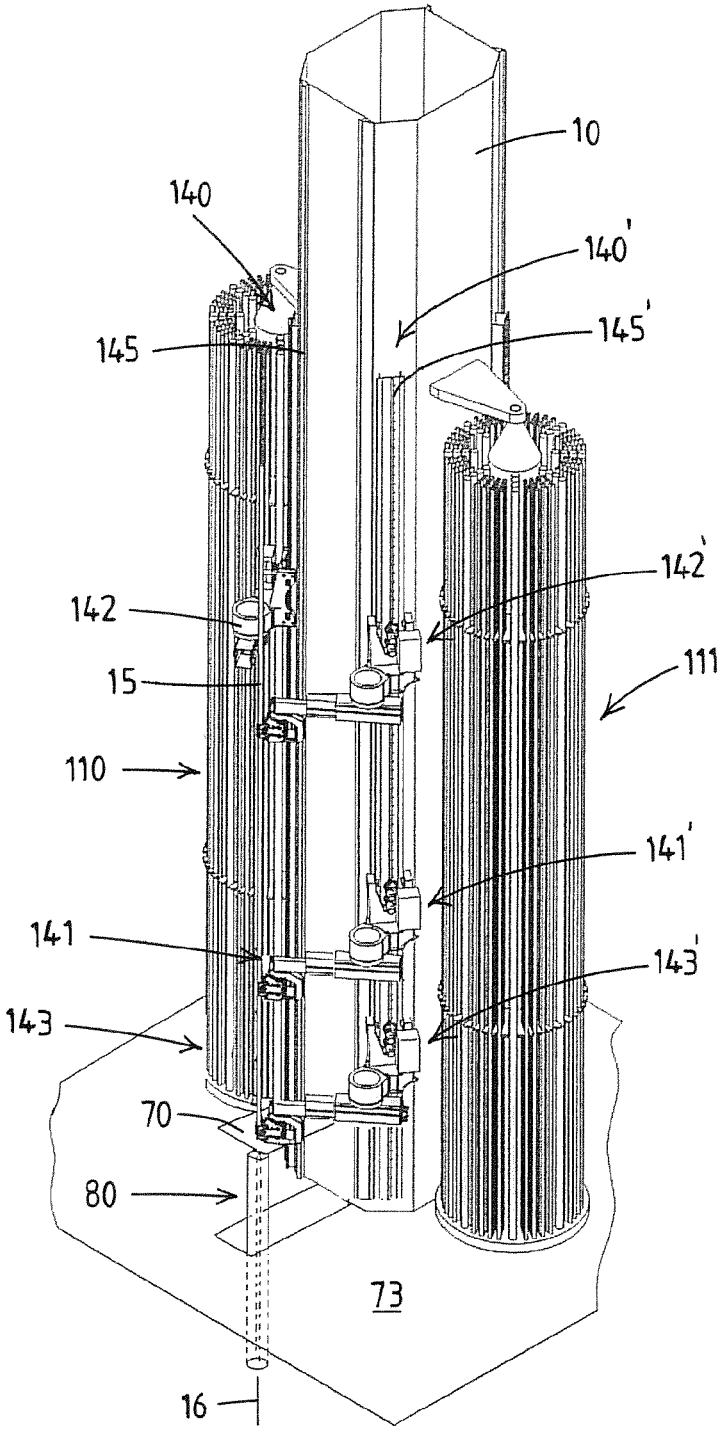
Figure 12:
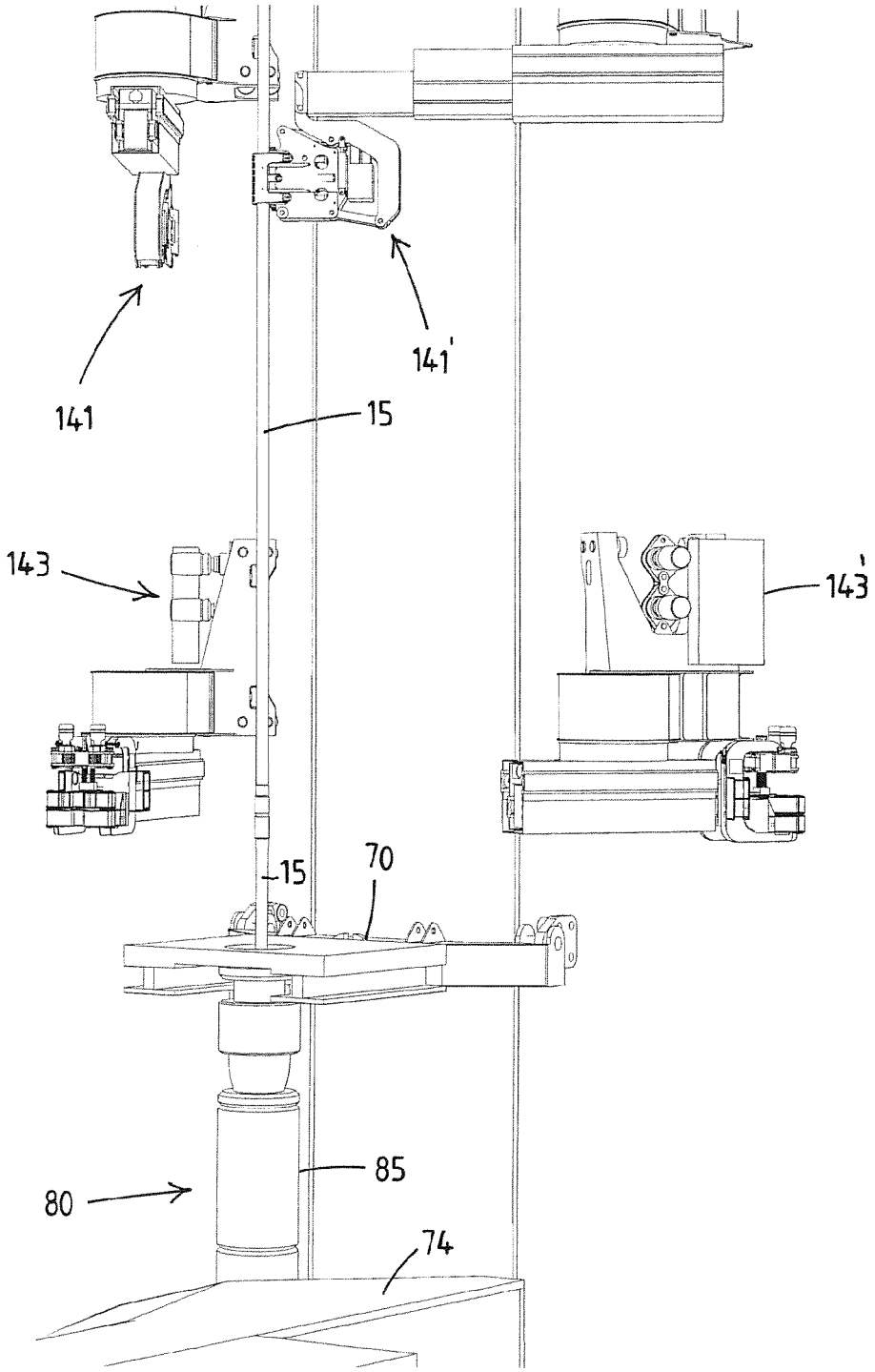
Figure 13:
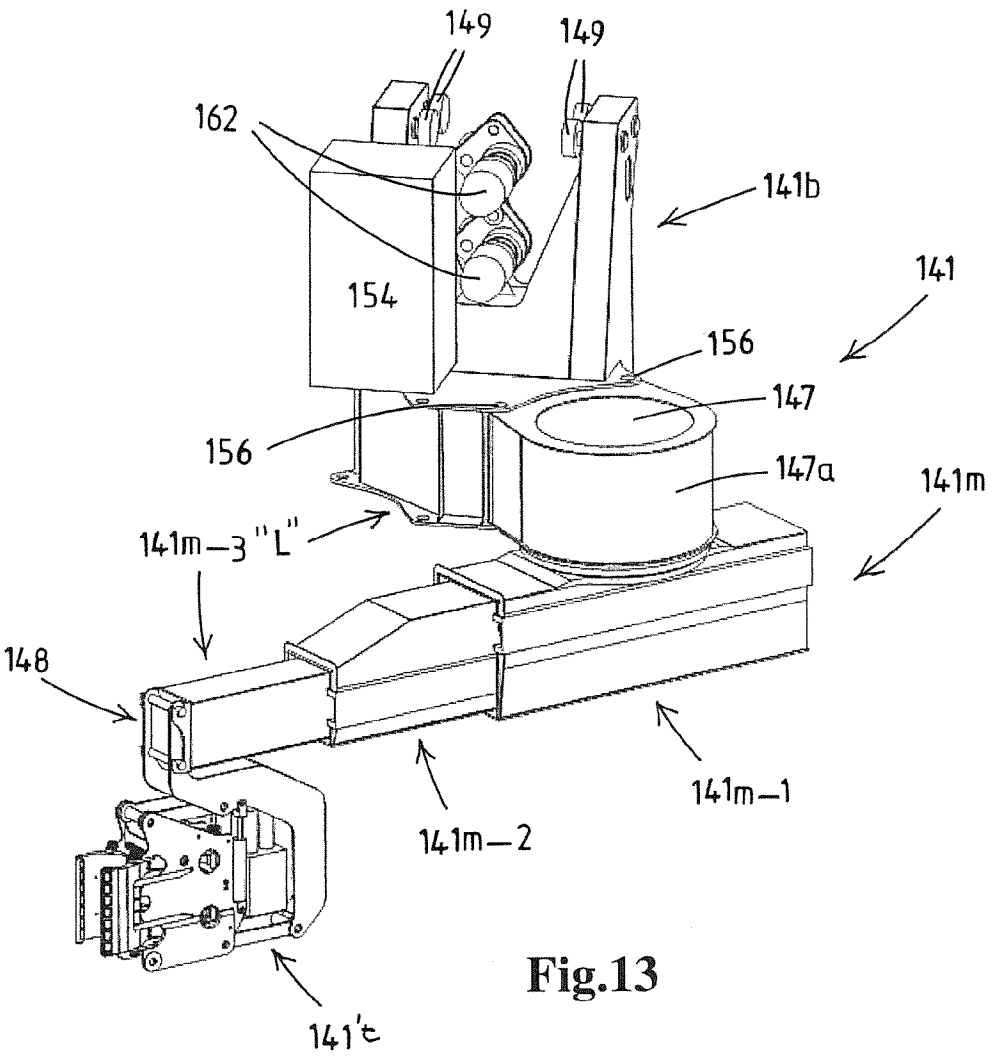
Figure 14:
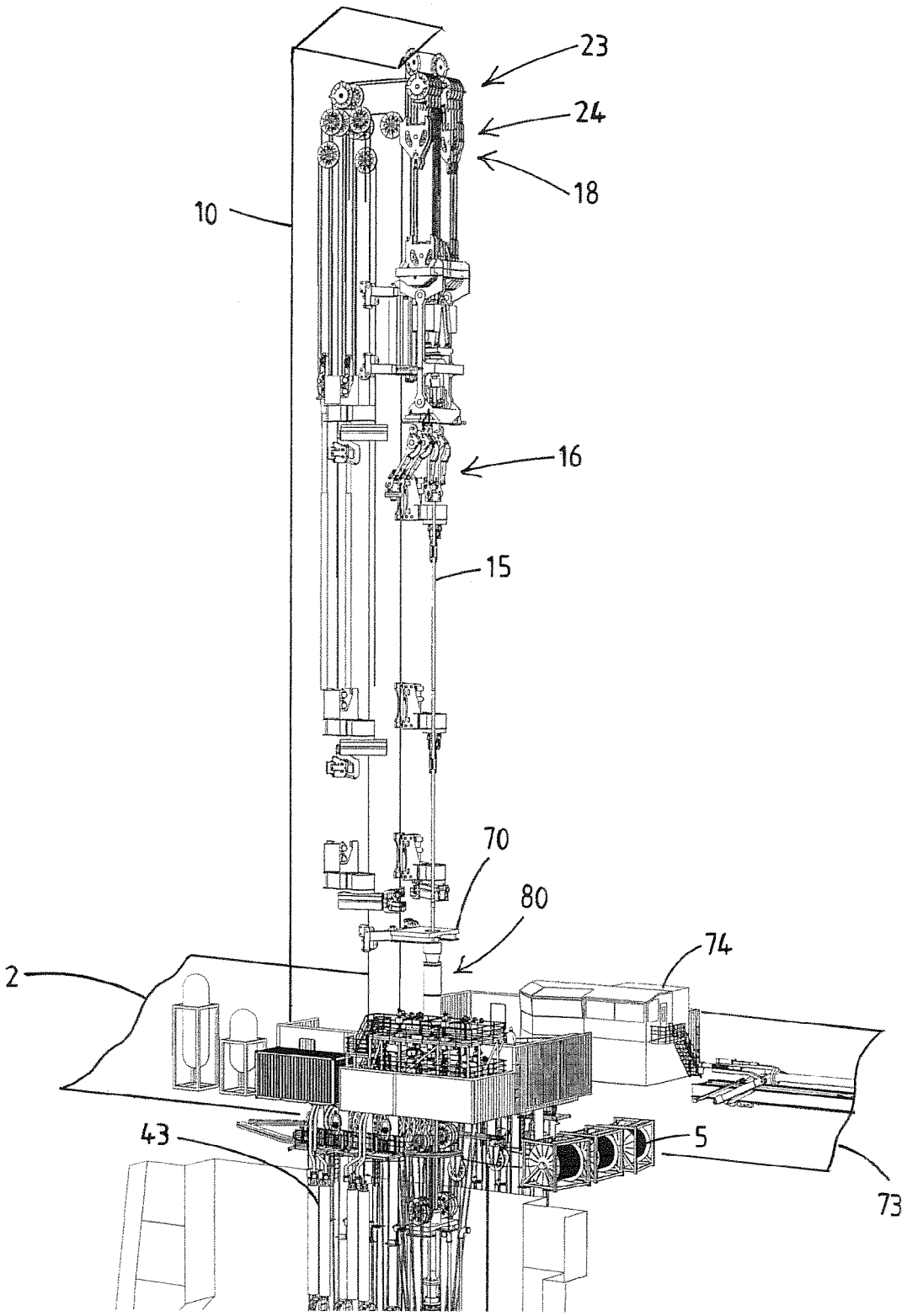

The aspects of the invention will now be explained with reference to the drawings. In the drawings:

FIG. 1 shows schematically in vertical cross-section a drilling vessel according to the invention, FIG. 2 shows a portion of the vessel with the drilling mast with a compensator cylinder therein and mobile working deck, as well as the slip joint to illustrate the invention, FIG. 3 shows schematically the mast of FIG. 1, FIG. 4 shows a portion of FIG. 3 to illustrate the heave compensator cylinders therein, FIG. 5 shows schematically the main hoisting device and the cable connection system of the vessel of FIG. 1, FIG. 6 shows a portion of FIG. 5 to illustrate the cable connection system, FIG. 7 illustrates the slip joint with the riser tensioning system and the cable connection system, FIG. 8 shows the situation of FIG. 7 from a different angle, FIG. 9 illustrates the cable connection system in a lower position of the heave compensation mode, FIG. 10 illustrates the cable connection system in an upper position of the heave compensation mode, FIG. 11 illustrates the mast of the vessel of FIG. 1, with the mobile working deck, the mast being provided with a vertical rails whereon two mobile pipe racker arm units and a mobile iron roughneck device are mobile in heave compensation mode, and with pipe storage carousels mounted on the hull, FIG. 12 illustrates the assembly of a new drill pipe to the drill string in heave motion, FIG. 13 illustrates a motion arm unit of FIGS. 11 and 12 carrying a tubular gripper member, FIG. 14 illustrates the mast, moonpool, and drilling firing line equipment of the vessel of FIG. 1.

With reference to the drawings an example of an offshore drilling system for performing subsea wellbore related activities, e.g. drilling a subsea wellbore, according to the invention will be discussed.

The system comprises a drilling vessel 1 having a floating hull 2 subjected to heave motion, the hull comprising a moonpool 5, here the moonpool having a fore portion 5*a* and an aft portion 5*b*.

As is preferred the vessel 1 is a mono-hull vessel with the moonpool extending through the design waterline of the vessel. In another embodiment, for example, the vessel is a semi-submersible vessel having submergible pontoons (possibly an annular pontoon) with columns thereon that support an above-waterline deck box structure. The moonpool may then be arranged in the deck box structure.

The vessel is equipped with a drilling tower 10 at or near the moonpool. In this example, as is preferred, the tower is a mast having a closed outer wall and having a top and a base. The base of the mast is secured to the hull 2. In this example the mast is mounted above the moonpool 5 with the base spanning the moonpool in transverse direction.

In another embodiment the tower can be embodied as a derrick, e.g. with a latticed derrick frame standing over the moonpool.

The vessel 1 is provided with a tubular string main hoisting device, the tubular string for example being a drill string 15.

The main hoisting device comprises:

- a main hoisting winch, here first and second winches 20, 21, and a main cable 22 that is connected to said winches 20, 21,
- a crown block 23, here at the top end of the mast 10, and a travelling block 24 that is suspended from the crown block 23 in a multiple fall arrangement of the main cable 22.

The travelling block 24 is adapted to suspend a tubular sting, e.g. a drill string 15, therefrom along a firing line 16, here shown (as preferred) with an intermediate topdrive 18 that is supported by the travelling block 24 and that is adapted to provide a rotary drive for the drill string.

The vessel 1 is provided with a heave compensation system adapted to provide heave compensation of the travelling block 24. This heave compensation system comprises a main cable heave compensation sheave, here two sheaves 30,31, one each in the path between each of the main hoisting winches 20, 21 and the travelling block 24. These sheaves 30, 31 are each connected to a passive and/or active heave motion compensator device, here including hydraulic cylinders 32, 33 which are each connected to a respective main cable heave compensation cable sheave 30, 31. As is known in the art each cylinder 32, 33 is connected to a hydraulic/gas separator cylinder, one chamber thereof being connected to a gas buffer as is known in the art. Also, as is preferred, the cylinders 32, 33 are mounted within the mast in vertical orientation.

In an embodiment each heave motion compensator device comprise a hydraulic cylinder having a piston rod, the main cable heave compensation sheave being connected to said piston rod.

For example the compensator cylinders 32, 33 each have a stroke between 5 and 15 meters, e.g. of 6 meters.

The FIGS. 3 and 4 are primarily included to illustrate a preferred mounting of these lengthy cylinders 32, 33 vertically within the mast 10 and the fully extended and retracted position of the piston rods thereof.

The vessel is furthermore provided with a riser tensioning system that is adapted to connect to a riser 19 extending along the firing line 16 between a subsea wellbore, e.g. a BOP on the subsea wellhead, and the vessel 1. The riser tensioning system comprises a tension ring 40 and tensioner members 41 connected to the tension ring 40. In the depicted example a wire line tensioning system is shown, with the members 41 being wires that run from the ring 40 upward to sheaves 42 and then to a tensioning arrangement, e.g. including cylinders 43 and a gas buffer.

The drawings further show the presence of a slip joint 50 having a lower outer slip joint barrel 51 and an upper inner slip joint barrel 52. As is known in the art the outer barrel 52 is adapted to be connected at its lower end, e.g. via bolts, to a fixed length section of the riser 19 extending to the seabed. As is known in the art and not shown in detail here the slip joint is provided with a locking mechanism 53, e.g. including hydraulically activated locking dogs, which is adapted to lock the slip joint in a collapsed position. As explained in the introduction the slip joint has a higher pressure rating when collapsed and locked that in dynamic stroking mode, e.g. as the locked position includes an operative metal-to-metal seal in the slip joint.

As is known in the art the tension ring 40 of the riser tensioning system is adapted to be connected to the outer barrel 51 of the slip joint 50, thereby allowing to absorb the effective weight of the riser.

The vessel 1 is further provided with a cable connection system, which cable connection system comprises:

- an inner slip joint barrel connector 60 that is adapted to the secured to the inner slip joint barrel 52,
- a connection cable winch, here two winches 61, 62, and connection cable 63 connected to said two winches 61, 62 at either end of the cable,
- a top sheave assembly 64 supported in stationary operative position on the hull of the vessel in or above the moonpool 5, and a travelling bottom sheave assembly 65 secured to the inner slip joint barrel connector 60.

The connection cable 63 extends between the top sheave assembly 64 and the bottom sheave assembly 65 in a multiple fall arrangement, however, in a simple embodiment, a single fall arrangement may also be possible.

In the cable connection system a connection cable heave compensation sheave 66, 67 is arranged in the path between each of the connection cable winches 61, 62 and the top sheave assembly 64.

As can be seen each of the main cable heave compensation cable sheaves 30, 31 and is mechanically interconnected to one of the connection cable heave compensation sheaves 66, 67 so as to allow for synchronous motion thereof.

The vessel 1 is provided with a vertically mobile working deck 70 that is vertically mobile within a motion range including a lower stationary position 71, wherein the working deck is used as stationary drill floor deck with the slip joint 50 unlocked, and the motion range further including a heave compensation motion range 72 that lies higher than the lower stationary position 71. In this heave compensation motion range the working deck 70 can perform heave compensation motion relative to the hull of the vessel.

For example the heave compensation motion range is between 5 and 10 meters, e.g. 6 meters. For example the average height of the working deck in heave motion above the driller cabin deck 73 with cabin 74 of the vessel is about 10 meters.

The system further comprises an upper riser section 80 that is mounted at the top of the riser and extends upward from the inner barrel 52 of the slip joint 50 at least to above the lower stationary position 71 of the working deck, preferably to the heave compensation motion range of the deck 70.

A lower section member 81 here forms the rigid connection between the actual end of the inner barrel 52 and the connector 60, here with said member 81 having a collar 82 that rests on the connector 60. From said member 81 upwards a further riser member 83 extends upward to above the level 71, even in the lowermost heave motion situation depicted in FIG. 9. Above said riser member 83 equipment to be integrated with the riser top, such as preferably at least a rotating control device (RCD) 84, and a mudline connector 85 are mounted. For example other riser integrated equipment like an annular BOP 86 may be arranged here as well.

In the depicted example the working deck 70 rests on the upper riser section 80 and this upper riser section 80 is the sole vertical loads support of the working deck 70.

As best seen in FIG. 12 the height of the riser above the drillers cabin deck 73 with the drillers cabin 74 allows for the drilling personnel in this cabin to have a direct view on equipment in the upper riser section 80 and all lines attached thereto when operated with the slip joint 50 in collapsed and locked position, with the working deck 70 in heave motion in the elevated heave motion compensation range.

The inventive system can also be embodied such that the working deck 70, in heave motion compensation mode, does not rest with its weight and, if present, any load thereon (e.g. from the drill string suspended from a slip device on the working deck 70) on or entirely on the upper riser section. Then the working deck is provided with a downward depending deck frame, the travelling bottom sheave assembly 65 being connected to a lower end of said downward depending deck frame. Such a deck frame may e.g. include vertical braces, a lattice work, etc.

The drawings show that the working deck 70 has an opening 75 therein that is aligned with the firing line 16, the opening 75 being dimensioned to at least allow for passage of the tubular string 15 that extends into and through the riser 19, 80. The working deck is provided with a tubular string suspension device, e.g. a device known as a slip 77 in the drilling field.

The working deck may be provided with a rotary table.

The top sheave assembly 64 is arranged in its stationary operative position at a level below the working deck 70, here, as is preferred below the working deck when in its lower stationary position 71. If desired the top sheave assembly 64 can be movable between its stationary operative position and a retracted, e.g. sideways retracted, non-operative position. For example the top sheave assembly is mounted on a movable frame spanning the moonpool 5, e.g. movable on rails alongside the moonpool. Or the top sheave assembly can be suspended from an overhead deck structure 12 (here also forming the drillers cabin deck), e.g. with rails allowing to move the top sheave assembly between an operative and a retracted position. The provision of the top sheave assembly 64 below the working deck floor allows for unhindered access to the working deck, e.g. from the side in piperacking operations between the firing line and a tubular storage rack.

As shown best in FIGS. 5 and 6 the top and bottom sheave assemblies 64, 65 each have a left-hand set 64*a*, 65*a* with one or multiple sheaves and a right-hand set 64*b*, 65*b* with one or multiple sheaves, the left-hand and right-hand sets being arranged at opposites sides of the firing line and being spaced apart to allow for passage of a riser member 80 in the firing line and between the sets. As is preferred the sheaves of these sets have a common sheave axis that intersects the firing line 16.

A transition sheave 66 of the top sheave assembly is arranged at right angles to and generally between the sets 64*a, b*.

The sets 65*a,b* of the bottom sheave assembly are mounted on a carrier frame, or in another embodiment depicted in FIG. 6 a beam, that also carries or forms the inner barrel connector 60. For example the carrier frame or mean has a central recess or opening therein allowing the passage of the upper riser section.

In an embodiment one or more main cable sheaves connected to the travelling block 24 have an individual lower latching device allowing to connect and disconnect the individual sheave to and from the travelling block. Preferably these one or more sheaves also have an upper latching device allowing to latch the sheave to the crown block if the sheave is disconnected from the travelling block. This "splittable block" arrangement is known in the art.

In an embodiment, preferably in combination with a splittable block for the travelling block, one or more of the sheaves of the bottom sheave assembly 65 have an individual lower latching device allowing to connect and disconnect the individual sheave to and from the inner barrel connector 60. Preferably these one or more sheaves also have an upper latching device allowing to latch the sheave to the top sheave assembly 64 if the sheave is disconnected from the inner barrel connector.

As shown here the connector cable 63 extends from a sheave 68*a, b* at an elevated position along the mast 10 down along a face of the mast, e.g. along the exterior of an outer face of the mast, to a base sheave 69*a, b* at the base of the mast, and from said base sheave 69*a*, 69*b* to a top sheave assembly 64, preferably below the lower stationary position 71 of the working deck.

In FIG. 11 the mast of the vessel of FIG. 1 is illustrated in a perspective view, wherein same elements are indicated with same numerals.

The vessel is provided with a vertically mobile working deck 70 that is vertically mobile within a motion range including a lower stationary position, wherein the working deck is used as stationary drill floor deck with the slip joint unlocked, and the motion range further including a heave compensation motion range that lies higher than said lower stationary position. Such a position is shown in FIG. 11. The vessel is provided with a drillers cabin deck 73 with a drillers cabin (not shown) thereon, and the lower stationary position of the working deck is at said drillers cabin deck level.

The vessel is furthermore provided with a riser tensioning system (not shown) that is adapted to connect to a riser extending along firing line 16 between a subsea wellbore, e.g. a BOP on the subsea wellhead, and the vessel. The drilling system further comprises an upper riser section 80 that is mounted on the inner barrel (not shown) of a slip joint, and extends upward from such a slip joint at least to above the lower stationary position 71 of the working deck, preferably to the heave compensation motion range, as visible in FIG. 11.

The vessel is furthermore provided with a drilling tower, here embodied as a mast 10, of a closed hollow construction. The top section including the drawworks and topdrive has been removed in the drawing. Also shown are the storage racks 110, 111 for tubulars, e.g. drill pipes and casing, here multi-jointed tubulars. Such racks are also referred to as carousels.

At the side of the mast 10 facing the firing line 16 the drilling system is provided with a pipe racker system, here comprising two tubular racking devices 140 and 140', each mounted at a corner of the mast 10. If no mast is present, e.g. with a latticed derrick, a support structure can be provided to arrive at a similar arrangement of the racking devices 140 and 140' relative to the firing line 16.

In the shown embodiment, each racking device 140, 140' has multiple, here three racker assemblies. Here a lower first tubular racker assembly 141, 141', a second tubular racker assembly 142, 142', operable at a greater height than the first tubular racker assembly, and a third tubular racker assembly 143, 143'.

Each set of racker assemblies is arranged on a common vertical rails 145, 145' that is fixed to the mast 10, here each at a corner thereof.

In the embodiment of FIG. 11, a drill pipe multi-joint tubular may be held by racker assemblies 142' and 141' in the firing line above the well center 27, thereby allowing to connect the tubular to the upper riser section 80. Each of said assemblies 142' and 141' carries a tubular gripper member 142'*t* and 141'*t* at the end of the motion arm of the assembly.

The lower racker assembly 143 of the other racker device 140 carries an iron roughneck device 150, optionally with a spinner thereon as well.

According to a preferred embodiment of the invention, the pipe racker system is provided with a heave motion synchronization system, adapted to bring a drill pipe retrieved from a drill pipe storage rack into a vertical motion synchronous with the heave motion of the upper end of the riser, e.g. of the working deck resting thereon, thereby allowing the interconnect the drill pipe to a drill pipe string suspended from a slip device. Hence, in the shown embodiment, the two tubular racking devices 140 and 140', each with three racker assemblies, are mobile in heave compensation mode.

It is both conceivable that the racker assemblies are mobile in heave compensation mode with respect to their common vertical rails 145, 145', and that the common vertical rails 145, 145' with the racker assemblies are mobile in heave compensation mode with respect to the mast 10.

In FIG. 12 the assembly of a new drill pipe 15, held by the pipe racker system of FIG. 11 comprising racker assemblies mounted on vertical rails, which pipe racker system is provided with a heave motion synchronization system that brings the drill pipe 15 retrieved from a drill pipe storage rack (not shown) into a vertical motion synchronous with the heave motion of the upper end of the riser, thereby allowing the interconnect the drill pipe 15 to a drill pipe string suspended from a slip device to the drill string in heave motion is shown in a detailed perspective view. In FIG. 12, racker assemblies 143 and 143' and 141 and 141' are visible, wherein racker assembly 141' grips the drill pipe 15.

In the depicted example the working deck 70 rests on the upper riser section 80 and this upper riser section 80 is the sole vertical loads support of the working deck 70.

The upper riser section 80 comprises equipment to be integrated with the riser top, such as preferably at least a rotating control device (RCD) 84, and a mudline connector 85.

The height of the riser above the drillers cabin deck (not shown) with the drillers cabin 74 allows for the drilling personnel in this cabin to have a direct view on equipment in the upper riser section 80 and all lines attached thereto, with the working deck 70 in heave motion in the elevated heave motion compensation range.

In FIG. 13 a motion arm 141*m* of a racker assembly 141 of FIGS. 11 and 12 adapted to carry a tubular gripper member is shown in more detail. The motion arm 141*m* is here embodied a telescopic extensible arm, the arm having a first arm segment 141*m*-1 which is connected to the base 141*b* via a vertical axis bearing 147 allowing the motion arm 141*m* to revolve about this vertical axis. As is preferred this vertical axis forms the only axis of revolution of the motion arm. The motion arm has two telescoping additional arm segments 141*m*-2 and 141*m*-3, with the outer arm segment being provided with a connector 148 for a tubular gripper 141't and/or a well center tool (e.g. an iron roughneck device, multibolt torque tool, centralizer tool or guide).

The base 141*b* of the tubular racker assembly 141 is provided with one or more, here two, pinions (not shown) engaging with a vertical toothed rack (not shown). The base is provided with one or more motors 162, here two, driving the pinions, so as to allow for a controlled vertical motion of the racker assembly 141.

As is preferred the one or more motors 162 driving the one or more pinions 161 are electric motors. In an embodiment a supercapacitor is included in an electric power circuit feeding said one or more vertical motion motors, which allows the temporary storage of electricity that may be generated by said one or more motors during a downward motion of the assembly. This energy can then be used for the upward motion again.

In view of a reduction of the number of parts it is preferred for all motion arms to be identical, so that limited spare parts are needed. For example a single complete motion arm, or a single complete racker assembly is stored aboard the vessel.

In view of reduction of the number of parts it is preferred for the vertical axis bearing 147 between the base 141*b* and the motion arm 141*m* to be arranged in a bearing housing 147*a* that is releasable attached to the base 141*b* of the racker assembly. As depicted here the base 141*b* provides both a left-hand attachment position "L", as indicated in FIG. 13, and a right-hand attachment position, as shown in use in FIG. 13, for the bearing housing 147*a* which allows to use the same base in each of the racking devices 140 and 140'. As is preferred the attachment positions are formed by elements on the base having holes therein and the housing 147*a* having mating holes therein, so that one or more connector pins 156 can be used to secure the housing to the base.

In FIG. 14 a relevant part of the vessel of FIG. 1 is shown in a perspective view. In particular, floating hull 2 with moonpool 5 and mast 10 at or near the moonpool 5. A drill string 15 is held by a hoisting device comprising crown block 23 and travelling block 24. In particular, the travelling block 24 is adapted to suspend drill string 15, therefrom along a firing line 16, here shown (as preferred) with an intermediate topdrive 18 that is supported by the travelling block 24 and that is adapted to provide a rotary drive for the drill string.

The working deck 70 rests on the upper riser section 80 and this upper riser section 80 is the sole vertical loads support of the working deck 70.

The height of the riser above the drillers cabin deck 73 with the drillers cabin 74 allows for the drilling personnel in this cabin to have a direct view on equipment in the upper riser section 80 and all lines attached thereto, with the working deck 70 in heave motion in the elevated heave motion compensation range.

The invention claimed is:

1. An offshore drilling system for performing subsea wellbore related activities, wherein the drilling system comprises a drilling vessel, the drilling vessel comprising:

a floating hull subjected to heave motion, the hull comprising a moonpool;

a drilling tower at or near the moonpool;

a tubular string main hoisting device, the tubular string main hoisting device comprising:

a main hoisting winch and main cable connected to said winch; and a crown block and a travelling block suspended from said crown block in a multiple fall arrangement of said main cable, which travelling block is adapted to suspend a tubular string therefrom along a firing line; a heave compensation system adapted to provide heave compensation of the travelling block, the heave compensation system comprising a main cable heave compensation sheave in the path between said main hoisting winch and the travelling block, and a passive and/or active heave motion compensator device connected to said main cable heave compensation cable sheave; and a riser tensioning system adapted to connect to a riser extending along the firing line between the subsea wellbore and the vessel, the riser tensioning system comprising a tension ring and tensioner members connected to said tension ring, wherein the drilling system further comprises a slip joint having a lower outer slip joint barrel and an upper inner slip joint barrel, wherein the outer barrel is adapted to be connected to a fixed length section of the riser extending to the subsea wellbore, and wherein the slip joint is provided with a locking mechanism adapted to lock the slip joint in a collapsed position, wherein the tension ring of the riser tensioning system is adapted to be connected to the outer barrel of the slip joint, wherein the vessel is further provided with a cable connection system, which cable connection system comprises:

an inner slip joint barrel connector that is adapted to be secured to the inner slip joint barrel;

a connection cable winch and connection cable;

a top sheave assembly supported in stationary operative position on the hull of the vessel in or above the moonpool, and a travelling bottom sheave assembly secured to the inner slip joint barrel connector, wherein the connection cable extends between the top sheave assembly and the bottom sheave assembly in a multiple fall arrangement; and a connection cable heave compensation sheave in the path between the connection cable winch and the top sheave assembly, wherein the main cable heave compensation cable sheave and the connection cable heave compensation sheave are mechanically interconnected so as to allow for synchronous motion thereof.

2. The system according to claim 1, wherein the vessel is provided with a vertically mobile working deck that is vertically mobile within a motion range including a lower stationary position, wherein the working deck is used as stationary drill floor deck with the slip joint unlocked, and the motion range further including a heave compensation motion range that lies higher than said lower stationary position.

3. The system according to claim 2, wherein the top sheave assembly is arranged in its stationary operative position at a level below the working deck.

4. The system according to claim 2, further comprising an upper riser section that is mounted on the inner barrel of the slip joint and extends upward from slip joint at least to above the lower stationary position of the working deck.

5. The system according to claim 2, wherein the main hoisting device comprises a first main hoisting winch and a second main hoisting winch, wherein the main cable is connected at either end thereof to a respective one of the first and second main hoisting winches.

6. The system according to claim 1, further comprising an upper riser section that is mounted on the inner barrel of the slip joint and extends upward from slip joint at least to above the lower stationary position of the working deck.

7. The system according to claim 6, wherein the working deck is adapted to rest onto the upper riser section, with said upper riser section being the sole vertical loads support of the working deck.

8. The system according to claim 7, wherein the vessel is provided with a drillers cabin deck and a drillers cabin thereon, with the lower stationary position of the working deck being at said drillers cabin deck level.

9. The system according to claim 6, wherein the vessel is provided with a drillers cabin deck and a drillers cabin thereon, with the lower stationary position of the working deck being at said drillers cabin deck level.

10. The system according to claim 1, wherein the main hoisting device comprises a first main hoisting winch and a second main hoisting winch, wherein the main cable is connected at either end thereof to a respective one of the first and second main hoisting winches.

11. The system according to claim 10, wherein the heave motion compensation device comprises a first main cable heave compensation sheave in the path between the first main hoisting winch and the travelling block, a passive and/or active first heave motion compensator device connected to said first main cable heave compensation cable sheave, and the heave motion compensation device comprises a second main cable heave compensation sheave in the path between the second main hoisting winch and the travelling block, a passive and/or active second heave motion compensator device being connected to said second main cable heave compensation cable sheave.

12. The system according to claim 1, wherein the top and bottom sheave assemblies each have a left-hand set with one or multiple sheaves and a right-hand set with one or multiple sheaves, the left-hand and right-hand sets being arranged at opposites sides of the firing line and being spaced apart to allow for passage of a riser member in the firing line and between said sets.

13. The system according to claim 12, wherein the sets of the bottom sheave assembly are mounted on a carrier frame or beam that also carries or forms the inner barrel connector.

14. The system according to claim 1, wherein the tower is a mast having a top and a base, the base adjacent the moonpool, wherein one or more hydraulic cylinders of the one or more heave motion compensator devices are arranged within said mast.

15. The system according to claim 1, wherein the connector cable extends from a sheave at an elevated position along the drilling tower down along a face of the drilling tower, to a base sheave at the base of the drilling tower, and from said base sheave to a top sheave assembly.

16. A method for drilling a subsea wellbore, a comprising the step of using the system according to claim 1.

17. The method according to claim 16, wherein the method comprises:

arranging a riser string between a subsea wellhead and the drilling vessel, which riser string includes the slip, joint, wherein in one mode the slip joint is unlocked, and wherein in another mode the slip joint is collapsed and locked, so that the connector cable system is operative.

18. The method according to claim 17, wherein the vessel has a vertically mobile working deck that rests on the riser, and wherein the working deck performs a heave motion relative to the vessel in a heave motion compensation range as the slip joint is locked.

19. The method according to claim 16, wherein the riser string is provided with a rotating control device (RCD), above the slip joint, below the working deck, in the course of managed pressure drilling.

20. The method according to claim 16, wherein the vessel comprises a pipe racker system that is provided with a heave motion synchronization system adapted to bring a drill pipe retrieved from a drill pipe storage rack into a vertical motion synchronous with the heave motion of the upper end of the riser, thereby allowing the interconnect oft the drill pipe to a drill pipe string suspended from a slip device.

* * * * *